US008137134B1

(12) United States Patent
Chang

(10) Patent No.: US 8,137,134 B1
(45) Date of Patent: Mar. 20, 2012

(54) COAXIAL CABLE CONNECTOR WITH AN INSULATING MEMBER WITH A BENDABLE SECTION WITH A PAIR OF PROJECTIONS

(75) Inventor: Pao-Chen Chang, Taipei (TW)

(73) Assignee: EZCONN Corporation, Taipei (TW)

( * ) Notice: Subject to any disclaimer, the term of this patent is extended or adjusted under 35 U.S.C. 154(b) by 0 days.

(21) Appl. No.: 12/955,155

(22) Filed: Nov. 29, 2010

(51) Int. Cl.
*H01R 9/05* (2006.01)

(52) U.S. Cl. ..... 439/582

(58) Field of Classification Search ..... 439/578–585, 439/63

See application file for complete search history.

(56) References Cited

U.S. PATENT DOCUMENTS 6,508,668 B1 * 1/2003 Yamane ..... 439/582
6,790,082 B2 * 9/2004 Obayashi ..... 439/582
7,367,840 B2 * 5/2008 Chen et al. ..... 439/581
7,540,774 B1 * 6/2009 Hung et al. ..... 439/582
7,704,096 B2 * 4/2010 Liao et al. ..... 439/582
7,762,841 B2 * 7/2010 Ho ..... 439/582
7,806,726 B2 * 10/2010 Chen et al. ..... 439/582
7,874,870 B1 * 1/2011 Chen ..... 439/582

* cited by examiner

*Primary Examiner* — Chandrika Prasad
(74) *Attorney, Agent, or Firm* — Rosenberg, Klein & Lee

(57) ABSTRACT

A coaxial cable connector includes: a connection terminal having a base section and a pair of resilient clamping plates upward extending from two sides of the base section; an insulating member having an insulating main body for supporting the base section of the connection terminal, an insulating bendable section upward extending from one side of the insulating main body, and a pair of projections formed on two sides of the insulating bendable section corresponding to the resilient clamping plates; and a metal case for supporting the insulating main body of the insulating member. When the insulating bendable section is bent downward, the projections compress the resilient clamping plates to move inward so as to securely clamp an internal conductor of the coaxial cable. Accordingly, the resilient clamping plates of the connection terminal are electrically connected with the internal conductor of the coaxial cable.

3 Claims, 6 Drawing Sheets

COAXIAL CABLE CONNECTOR WITH AN INSULATING MEMBER WITH A BENDABLE SECTION WITH A PAIR OF PROJECTIONS

BACKGROUND OF THE INVENTION

1. Field of the Invention

The present invention relates generally to a coaxial cable connector, and more particularly to a coaxial cable connector in which the connection terminal can be securely connected with an internal conductor of a coaxial cable for reliable transmission of electrical signals.

2. Description of the Related Art

Numerous coaxial cables are used for the internal wiring of IT devices such as laptop computers and compact electronic devices such as home electric appliances, and such coaxial cables are usually used by being electrically connected to the respective conductors of other cables, substrates or the like.

In order to electrically connect such coaxial cables to, for example, a conductor of another cables, conventionally, internal conductors of the respective coaxial cables are one by one soldered to the conductor of other corresponding cables. As a result, internal conductors of coaxial cables were electrically connected to the conductors of other cables.

Nevertheless, with this electrical connection method, connection errors during the soldering process would often occur, and there is a problem in that the electrical connection between the internal conductors of coaxial cables and the conductors of other cables could not be conducted with precision.

Moreover, since the soldering process is complicated, there is a problem in that much time is required for the connection process, and that the loss is great due to failures of the connection process.

In order to overcome such problems, conventionally, a coaxial cable connector has been proposed as a device for electrically connecting the internal conductors of coaxial cables and the conductors of other cables.

U.S. Pat. No. 6,790,082 discloses a coaxial cable connector including a connection terminal to be connected to an internal conductor of a coaxial cable, and a metal shell for supporting the connection terminal via an insulator. The connection terminal is bent with respective bending forces of the shell and the insulator to make a pair of contact plates of the connection terminal retain the internal conductor of the coaxial cable. Accordingly, electrical connection is established between the internal conductor of the coaxial cable and the connection terminal.

In the above structure, the internal conductor of the coaxial cable is clamped from upper and lower sides by the pair of contact plates to establish the electrical connection between the internal conductor of the coaxial cable and the connection terminal. However, the internal conductor of the coaxial cable can be hardly securely retained by means of the contact plates. This often leads to poor contact between the internal conductor and the contact plates. As a result, it cannot be ensured that the contact plates are lastingly electrically connected with the internal conductor of the coaxial cable and the quality of signal transmission will be affected.

SUMMARY OF THE INVENTION

A primary object of the present invention is to provide a coaxial cable connector, which can be effectively mechanically and electrically connected with an internal conductor of a coaxial cable.

To achieve the above and other objects, the coaxial cable connector of the present invention includes: connection terminal having a base section and a pair of resilient clamping plates upward extending from two sides of the base section; an insulating member having an insulating main body for supporting the base section of the connection terminal, an insulating bendable section upward extending from one side of the insulating main body, and a pair of projections formed on two sides of the insulating bendable section corresponding to the resilient clamping plates; and a metal case for supporting the insulating main body of the insulating member. When the insulating bendable section is bent downward, the projections compress the resilient clamping plates to move inward so as to securely clamp an internal conductor of the coaxial cable. Accordingly, the resilient clamping plates of the connection terminal are electrically connected with the internal conductor of the coaxial cable.

BRIEF DESCRIPTION OF THE DRAWINGS

The structure and the technical means adopted by the present invention to achieve the above and other obj ects can be best understood by referring to the following detailed description of the preferred embodiments and the accompanying drawings, wherein.

DETAILED DESCRIPTION OF THE PREFERRED EMBODIMENT

Figure 1:
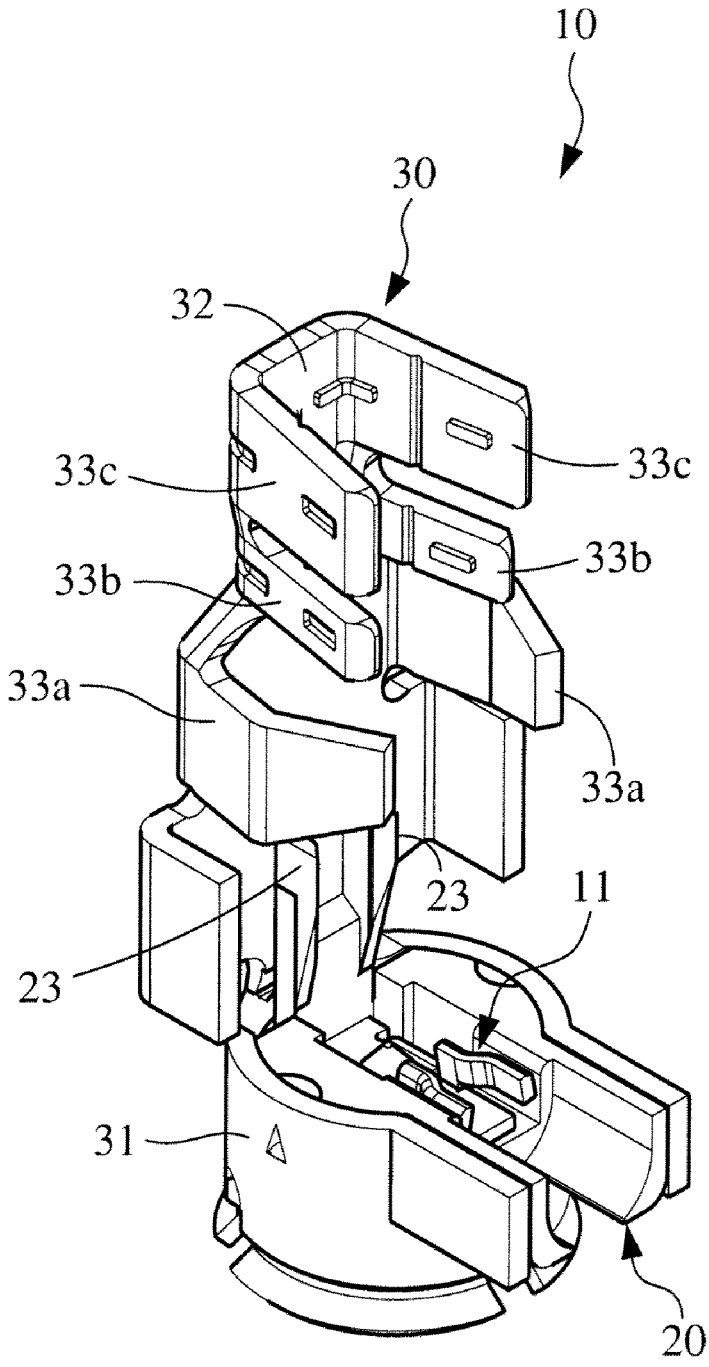
FIG. 1 is a perspective assembled view of the coaxial cable connector of the present invention.
Figure 2:
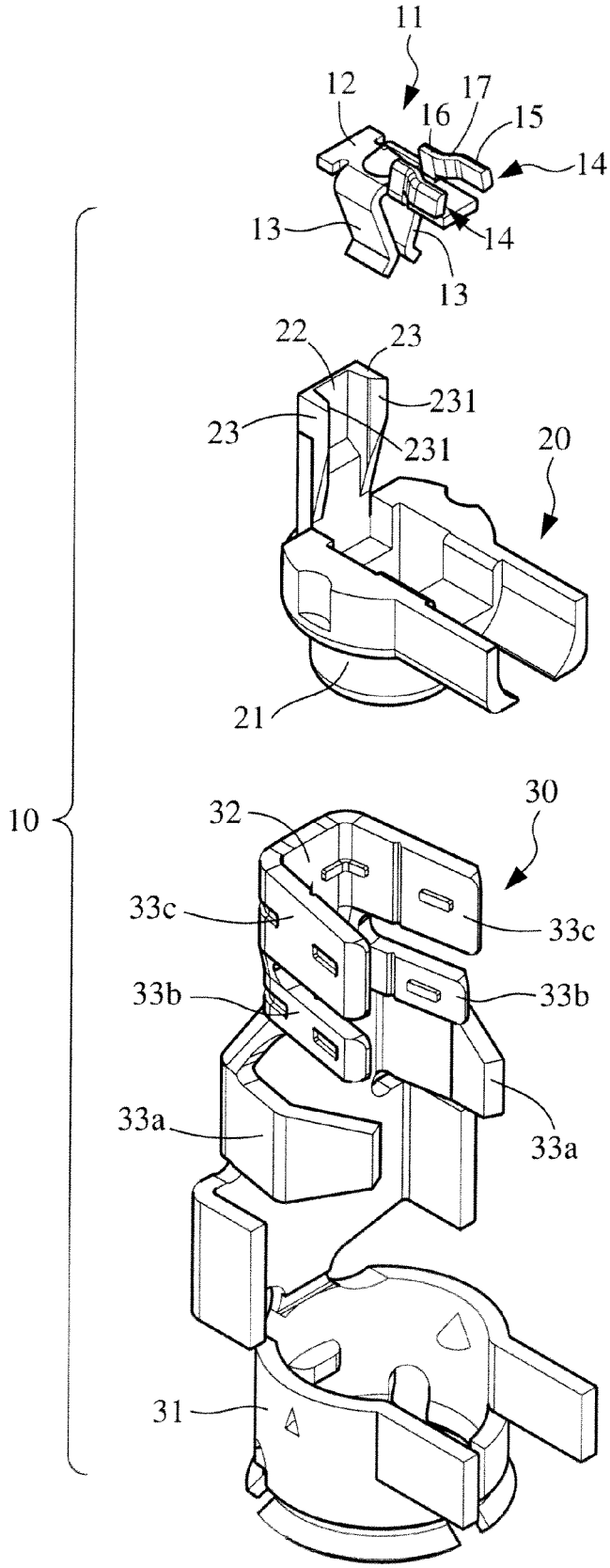
FIG. 2 is a perspective exploded view of the coaxial cable connector of the present invention.

Please refer to FIGS. 1 and 2. FIG. 1 is a perspective assembled view of the coaxial cable connector of the present invention. FIG. 2 is a perspective exploded view of the coaxial cable connector of the present invention. The coaxial cable connector 10 includes a connection terminal 11, an insulating member 20 and a metal case 30.

Figure 3:
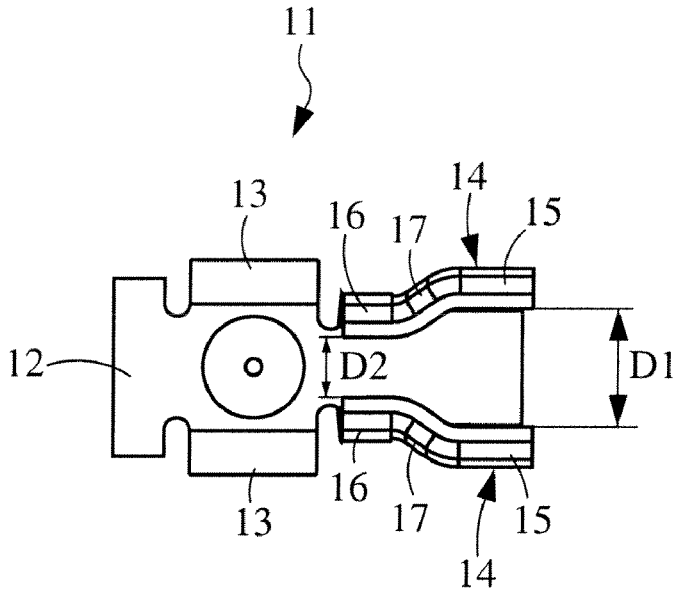
FIG. 3 is a top view of the connection terminal of the coaxial cable connector of the present invention.
Figure 4:
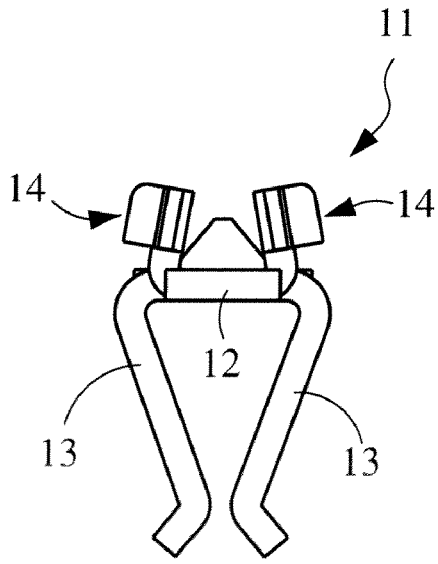
FIG. 4 is a front view of the connection terminal of the coaxial cable connector of the present invention.

Referring to FIGS. 3 and 4, the connection terminal 11 includes a base section 12, a pair of connection sections 13 downward extending from two sides of the base section 12 and a pair of resilient clamping plates 14 upward extending from two sides of the base section 12. Each resilient clamping plate 14 has a front end section 15, a rear end section 16 and an oblique connection section 17 connected between the front and rear end sections 15, 16. The oblique connection section 17 is inward bent from a terminal of the front end section 15 to connect with a terminal of the rear end section 16. Accordingly, the two front end sections 15 are spaced from a distance D1 larger than a distance D2 between the two rear end sections 16 to form a configuration with wider front side and narrower rear side.

The insulating member 20 is disposed between the connection terminal 11 and the metal case 30. The insulating member 20 has an insulating main body 21 for supporting the base section 12 of the connection terminal 11. The insulating member 20 further has an insulating bendable section 22 upward extending from one side of the insulating main body

21. The insulating bendable section 22 can be bent toward the insulating main body 21. The insulating member 20 further has a pair of projections 23 formed on two sides of the insulating bendable section 22 corresponding to the resilient clamping plates 13. Each projection 23 has a bottom end formed with a slope 231.

The metal case 30 has a case main body 31 for supporting the insulating main body 21 of the insulating member 20. The metal case 30 further has a case bendable section 32 positioned in parallel to the insulating bendable section 22 of the insulating member 20. The case bendable section 32 and the insulating bendable section 22 can be bent together. The metal case 30 further has first connection sections 33*a* formed on two sides of the case bendable section 32.

In addition, the metal case 30 further has second connections 33*b* formed on two sides of the case bendable section 32 and third connection sections 33*c* also formed on two sides of the case bendable section 32.

Figure 5A:
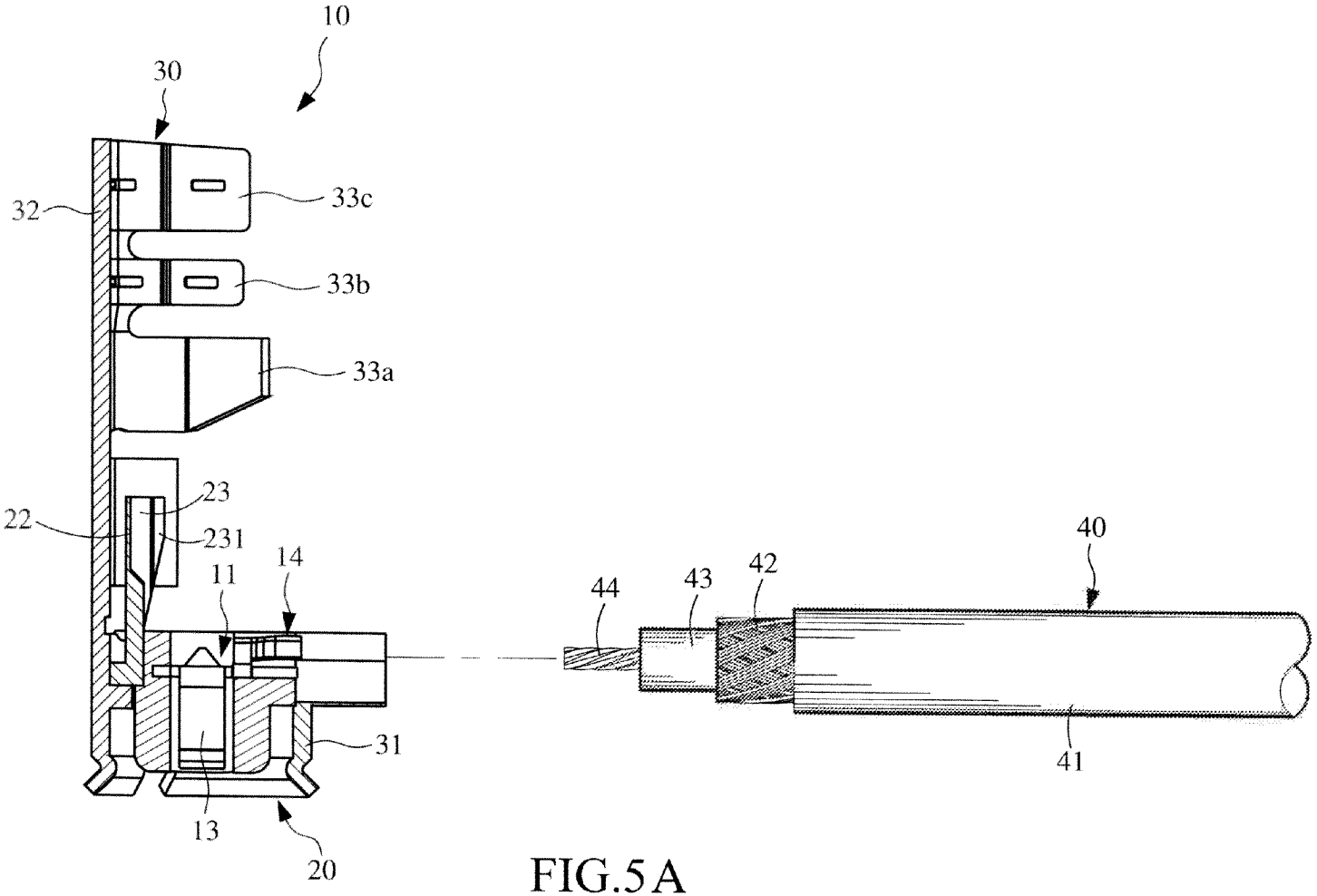
FIGS. 5A to 5D show the installation process of the coaxial cable on the coaxial cable connector of the present invention.
Figure 5B:
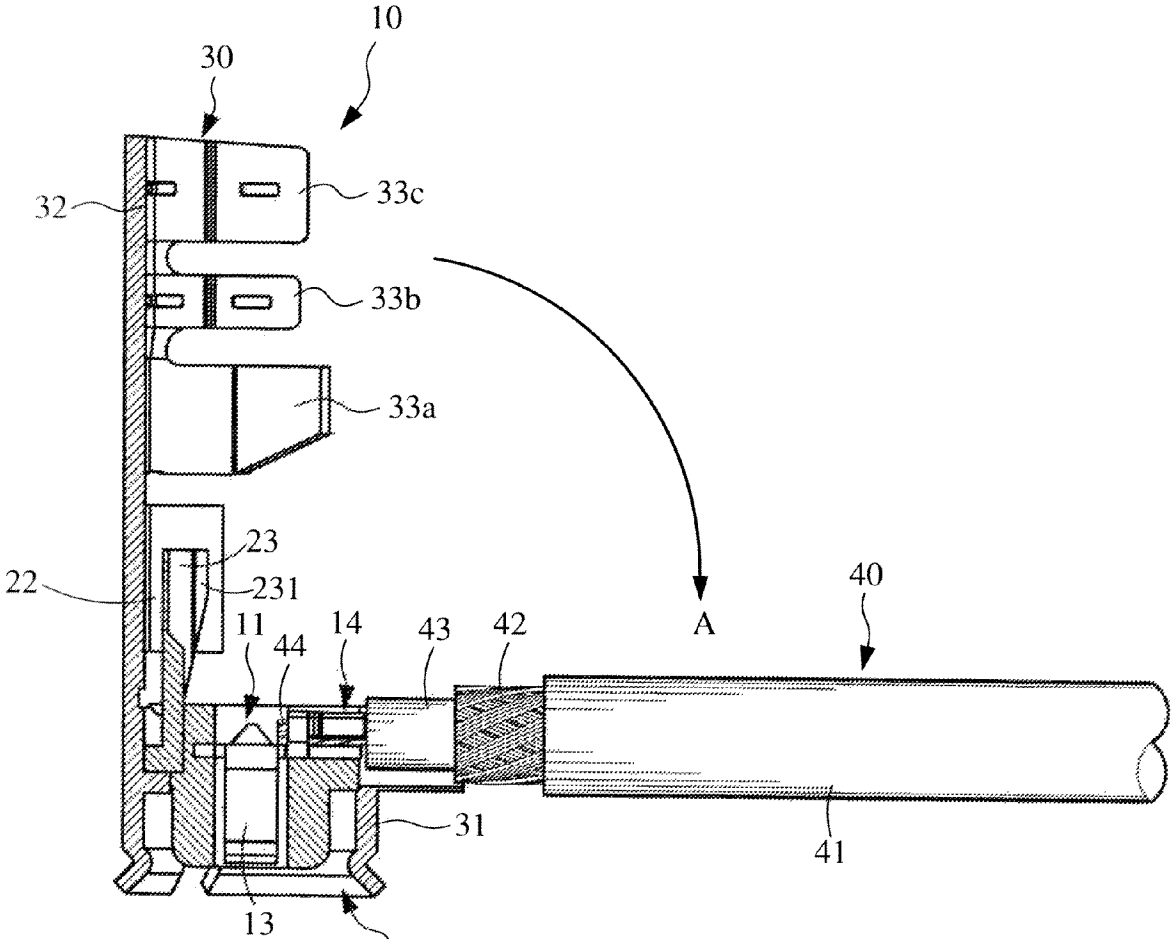

FIGS. 5A to 5D show the installation process of the coaxial cable 40 on the coaxial cable connector 10. The skin 41 of a free end of the coaxial cable 40 is partially removed to expose an external conductor 42, an insulator 43 and an internal conductor 44. In a first step, the coaxial cable 40 is inserted into the connection terminal 11 of the coaxial cable connector 10 as shown in FIG. 5A. At this time, the internal conductor 44 of the coaxial cable 40 is positioned between the two resilient clamping plates 14 of the connection terminal 11 as shown in FIG. 5B.

Figure 5C:
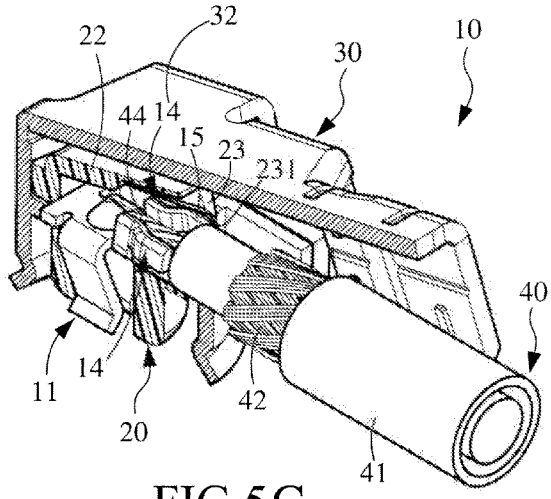
Figure 5D:
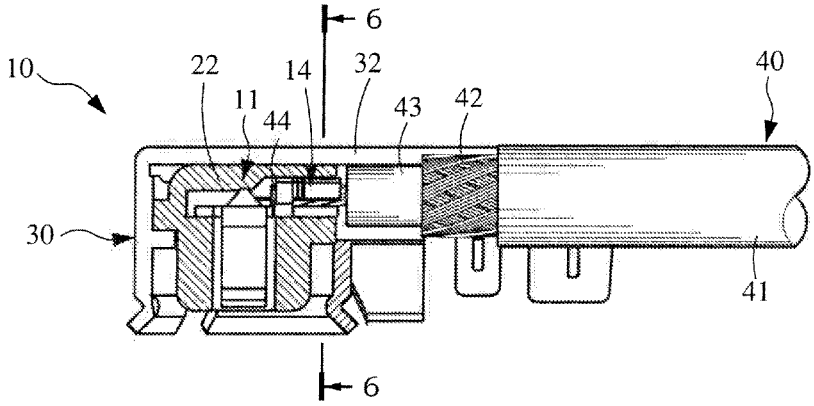
Figure 6:
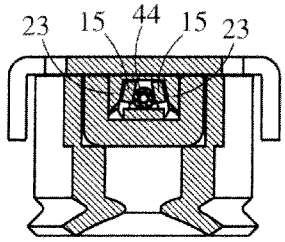
FIG. 6 is a sectional view taken along line 6-6 of FIG. 6D.

Then, a force in the direction of arrow A is applied to the metal case 30 to forcedly bend the case bendable section 32 of the metal case 30 and the insulating bendable section 22 of the insulating member 20. When bent, under the downward pressing force of the insulating bendable section 22, the slopes 231 of the projections 23 compress the front end sections 15 of the resilient clamping plates 14 to move inward (as shown in FIG. 5C) so as to securely clamp the internal conductor 44 of the coaxial cable 40. Under such circumstance, the resilient clamping plates 14 is reliably mechanically and electrically connected with the internal conductor 44 of the coaxial cable 40 as shown in FIGS. 5D and 6.

Moreover, the case bendable section 32 is securely connected with the case main body 31 via the first connection sections 33*a*. In addition, the case bendable section 32 and the second connection sections 33*b* together hold the external conductor 42 of the coaxial cable 40. Also, the case bendable section 32 and the third connection sections 33*c* together hold the skin 41 of the coaxial cable 40. Accordingly, the coaxial cable connector 10 can be tightly connected with the free end of the coaxial cable 40.

The above embodiment is only used to illustrate the present invention, not intended to limit the scope thereof. It is understood that many changes or modifications of the above embodiment can be made by those who are skilled in this field without departing from the spirit of the present invention. The scope of the present invention is limited only by the appended claims.

What is claimed is:

1. A coaxial cable connector comprising:

a connection terminal having a base section and a pair of resilient clamping plates upward extending from two sides of the base section;

an insulating member having an insulating main body for supporting the base section of the connection terminal, an insulating bendable section upward extending from one side of the insulating main body, and a pair of projections formed on two sides of the insulating bendable section corresponding to the resilient clamping plates; and a metal case for supporting the insulating main body of the insulating member, when the insulating bendable section is bent downward, the projections compressing the resilient clamping plates to move inward so as to securely clamp an internal conductor of the coaxial cable, whereby the resilient clamping plates of the connection terminal are electrically connected with the internal conductor of the coaxial cable.

2. The coaxial cable connector as claimed in claim 1, wherein each resilient clamping plate has a front end section, a rear end section and an oblique connection section connected between the front and rear end sections, a distance between the two front end sections of the resilient clamping plates being larger than a distance between the two rear end sections of the resilient clamping plates.

3. The coaxial cable connector as claimed in claim 2, wherein each projection of the insulating member has a bottom end formed with a slope, whereby when the projections of the insulating bendable section are bent downward, the slopes of the projections compress the front end sections of the resilient clamping plates to move inward.

* * * * *